US007559299B2

(12) United States Patent
Brower et al.

(10) Patent No.: US 7,559,299 B2
(45) Date of Patent: Jul. 14, 2009

(54) MONOLITHIC CYLINDER-CRANKCASE

(75) Inventors: David R. Brower, Townville, SC (US); Charles A. Eakins, Jr., Liberty, SC (US); Nagesh S. Mavinahally, Anderson, SC (US); Roger Klink, Greer, SC (US); Anthony S. Thomas, Anderson, SC (US); Fabio T. Romero, Simpsonville, SC (US); John Frederick Morris, Anderson, SC (US)

(73) Assignee: Eastway Fair Company Limited (VG)

( * ) Notice: Subject to any disclaimer, the term of this patent is extended or adjusted under 35 U.S.C. 154(b) by 0 days.

(21) Appl. No.: 11/655,486

(22) Filed: Jan. 19, 2007

(65) Prior Publication Data

US 2008/0173171 A1 Jul. 24, 2008

(51) Int. Cl.
*F02B 25/00* (2006.01)
*F02B 33/04* (2006.01)

(52) U.S. Cl. ..... 123/73 PP; 123/195 R

(58) Field of Classification Search ..... 123/195 R, 123/65 R, 73 PP
See application file for complete search history.

(56) References Cited

U.S. PATENT DOCUMENTS

| | | | | |
|---|---|---|---|---|
| 2,218,332 | A | 10/1940 | Fowler | |
| 2,740,393 | A | 4/1956 | Hoffman | |
| 3,561,416 | A | 2/1971 | Kiekhaefer | |
| 3,973,548 | A | 8/1976 | Celli | |
| 4,394,850 | A | 7/1983 | Hayashi | |
| 4,419,801 | A | 12/1983 | Yamashita et al. | |
| 4,630,345 | A | 12/1986 | Lutz | |
| 4,644,911 | A | 2/1987 | Hidaka et al. | |
| 4,712,517 | A | 12/1987 | Anno et al. | |
| 4,905,642 | A | 3/1990 | Suzuki et al. | |
| 5,016,584 | A | 5/1991 | Inoue et al. | |
| 5,217,059 | A | 6/1993 | Kuhn et al. | |
| 5,357,921 | A | 10/1994 | Katoh et al. | |
| 5,370,087 | A | 12/1994 | Guimond et al. | |
| 5,419,037 | A | 5/1995 | Bailey | |
| 5,755,028 | A | 5/1998 | Takami et al. | |
| 6,250,273 | B1 * | 6/2001 | Ryu et al. | 123/195 C |
| 6,289,856 | B1 * | 9/2001 | Noguchi | 123/73 PP |
| 6,418,903 | B2 * | 7/2002 | Muller et al. | 123/195 R |
| 6,491,006 | B2 * | 12/2002 | Jonsson et al. | 123/73 R |
| 6,595,178 | B2 * | 7/2003 | Araki | 123/195 R |
| 6,612,275 | B2 | 9/2003 | Immel et al. | |
| 6,848,399 | B2 * | 2/2005 | Watkins et al. | 123/73 PP |
| 6,874,455 | B2 * | 4/2005 | Geyer et al. | 123/73 PP |
| 6,904,883 | B2 | 6/2005 | Snyder et al. | |
| 6,941,914 | B2 | 9/2005 | Snyder et al. | |
| 6,953,011 | B2 * | 10/2005 | Geyer et al. | 123/73 PP |
| 6,973,899 | B2 * | 12/2005 | Warfel et al. | 123/73 PP |
| 7,021,252 | B2 * | 4/2006 | Warfel et al. | 123/73 PP |
| 7,055,485 | B1 * | 6/2006 | Davis et al. | 123/195 R |
| 2002/0185093 | A1 * | 12/2002 | Immel et al. | 123/90.31 |

FOREIGN PATENT DOCUMENTS

| | | | |
|---|---|---|---|
| JP | 2008-175200 | * | 7/2008 |

* cited by examiner

*Primary Examiner*—Hai H Huynh
(74) *Attorney, Agent, or Firm*—Michael Best & Friedrich LLP

(57) ABSTRACT

A cylinder-crankcase is disclosed that includes a cylinder block having a cylinder head for receiving a spark plug. The cylinder-crankcase also includes a crankcase and a crank arm for supporting a crankshaft. The cylinder block, cylinder head, crankcase and crank arm are a single, monolithic piece.

28 Claims, 7 Drawing Sheets

MONOLITHIC CYLINDER-CRANKCASE

BACKGROUND

The present application relates to internal combustion engines, and, in particular, to cylinder crankcase assemblies.

Two-stroke, internal combustion engines usually are small (as opposed to 4-stroke engines) and therefore they are commonly used for lightweight vehicles such as motorcycles, mopeds or and motorized garden appliances such as trimmers, blowers, and chainsaws. Generally, it is desirable for these engines to be of a light weight.

The two-stroke engine generally is composed of a crankcase, cylinder block, and cylinder head, collectively referred to as a "cylinder crankcase short block." Typically, a cylinder crankcase short block is made from separate components that need to be machined and fastened together, thus requiring mounting holes to be carefully machined within certain tolerances. Moreover, the fasteners add additional weight to the cylinder crankcase short block.

Cylinder crankcase short blocks also require seals between the components to avoid the leakage of air and/or fuel. The use of seals exposes the cylinder crankcase to failures such as the deterioration of a seal or leaking.

U.S. Pat. No. 2,489,150 to McCoy discloses an integrally cast cylinder crankcase and block. The cylinder head is a separate piece that must be mounted to the cylinder block so that a sleeve may be pressed into the cylinder block prior to the cylinder block being covered with the cylinder head. Similarly, U.S. Pat. No. 3,983,852 to Chatourel teaches a one-piece cylinder and crankcase with an integral cylinder head. The cylinder and crankcase casting of Chatourel, however, requires a separate cover that attaches to the casting. This cover "seals" the casting and acts as a support, or bearing surface, for a camshaft.

BRIEF SUMMARY

A cylinder-crankcase is disclosed herein that includes a cylinder block having a cylinder head for receiving a spark plug. The cylinder-crankcase also includes a crankcase, and a crank arm for supporting a crankshaft. The cylinder block, cylinder head, crankcase, and crank arm are a single, monolithic piece.

The present disclosure also includes a method for forming a cylinder-crankcase. The method includes forming a cylinder block, cylinder head, crankcase, and crank arm as a single, monolithic piece so that the cylinder-crankcase is formed without any fasteners and gaskets.

DETAILED DESCRIPTION OF THE DRAWINGS AND THE PRESENTLY PREFERRED EMBODIMENTS

Figure 1:
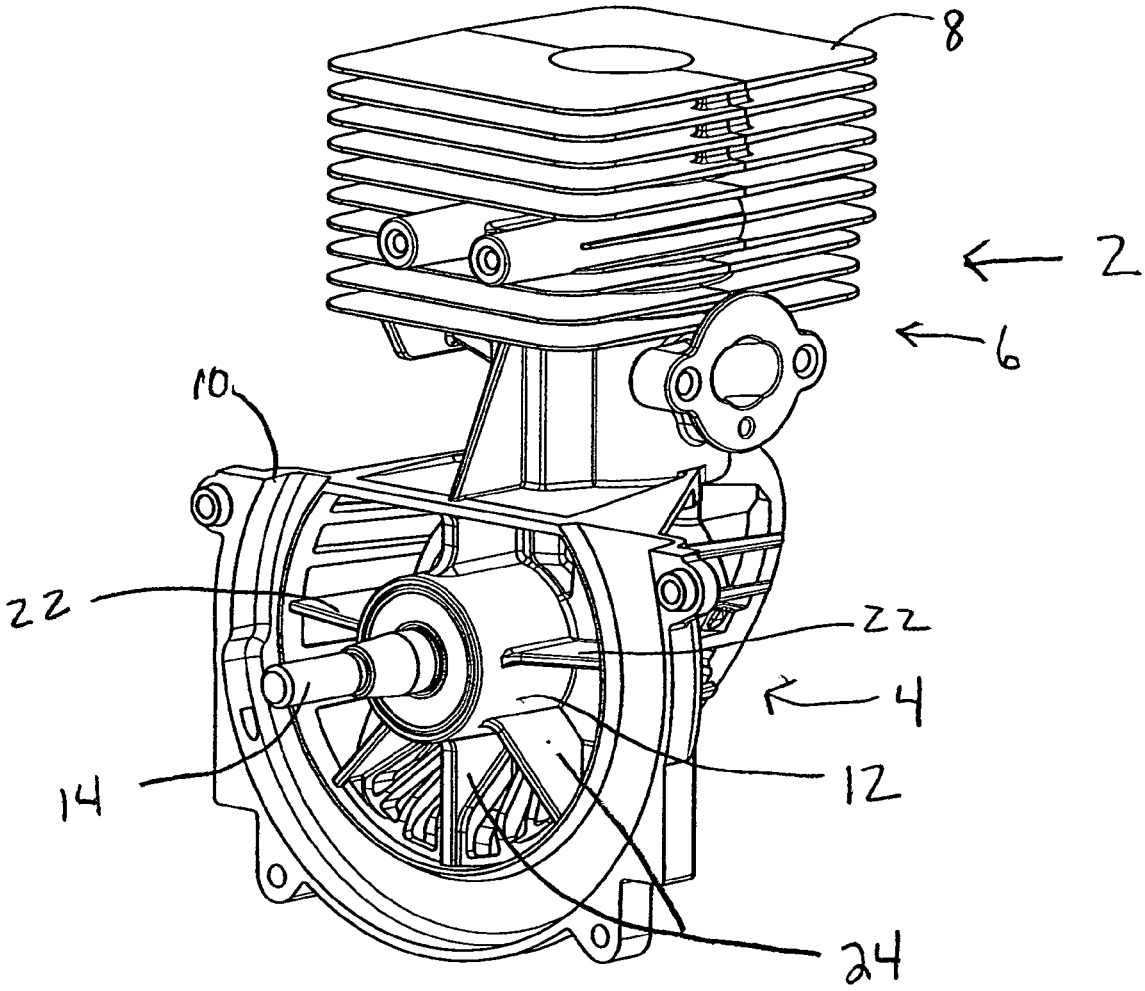
FIG. 1 is a front perspective view of a cylinder-crankcase with additional engine components attached.
Figure 2:
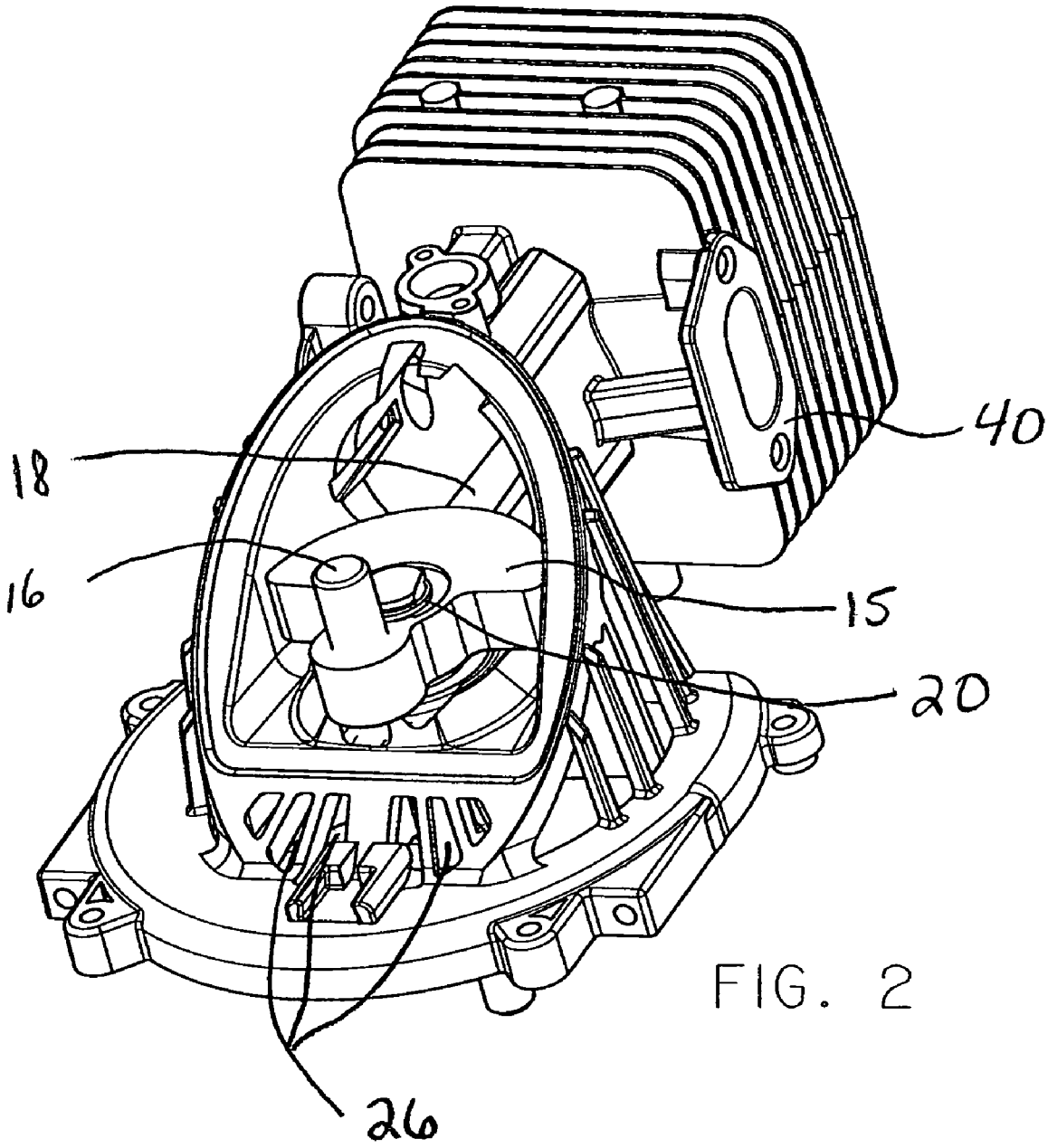
FIG. 2 is a rear perspective view of the cylinder-crankcase of FIG. 1.

Turning now to FIGS. 1 and 2, a monolithic cylinder-crankcase 2 for a two-stroke cylinder engine is shown. The cylinder-crankcase is integrally cast as a single, or monolithic, part, typically through a die-cast injection molding process. The cylinder-crankcase 2 may be made of steel, aluminum, magnesium, or any other metal or alloy that is suitable to withstand the higher temperatures to which the engine is exposed.

Figure 6:
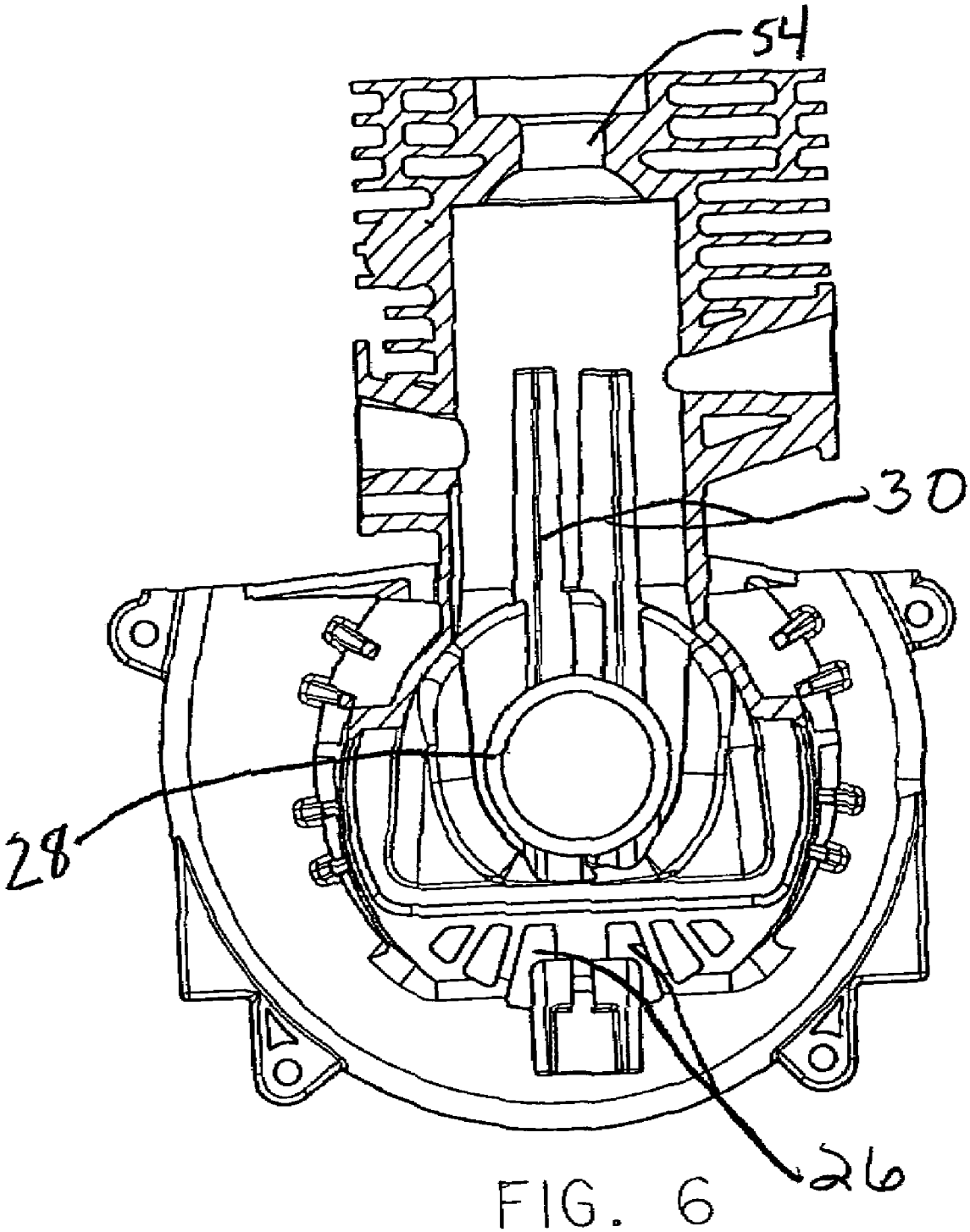
FIG. 6 is a rear plan view of a cylinder-crankcase, with a portion of the cylinder block and crankcase removed.
Figure 7:
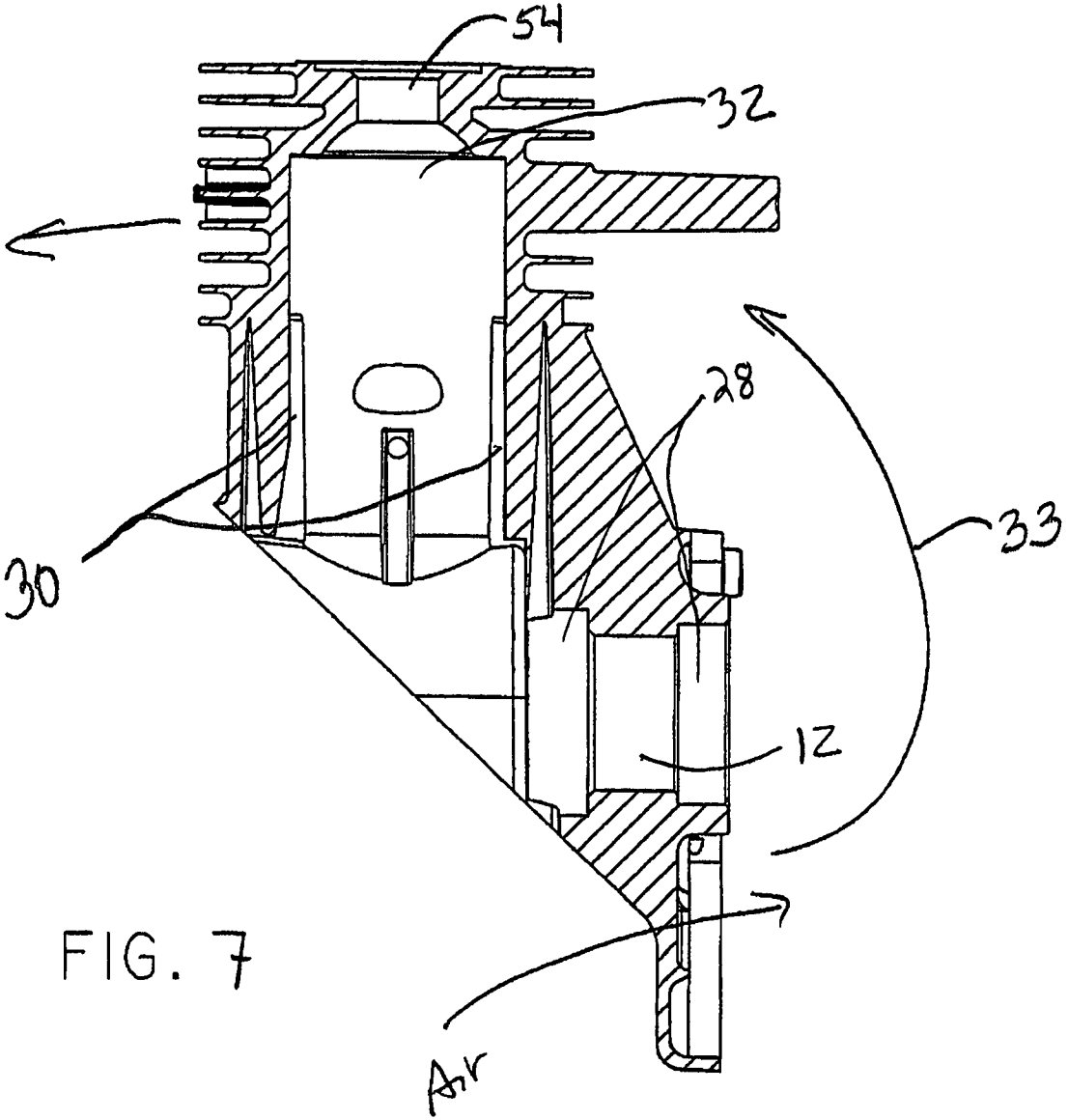
FIG. 7 is a side view of a cylinder-crankcase, with a portion of the cylinder block and crankcase removed

The cylinder-crankcase 2 includes a crankcase 4, a cylinder block 6, and a cylinder head 8. The crankcase 4 includes a frame 10. The center of the frame 10 has a crank arm 12 for supporting a crank shaft 14. The crank arm 12 also supports a counterweight 15 (FIG. 2) for balancing the engine. The counterweight includes a connecting rod attachment point 16 for the attachment of a connecting rod 18 and associated bearing 20. Referring to FIGS. 6 and 7, each end of the crank arm 12 preferably includes a bearing bore 28, each of which supports a support bearing (not shown) associated with the crank shaft 14. The crank arm 12 and bearing bores 28 may be symmetrically or eccentrically located within the frame 10, depending on the configuration of the engine block. Preferably, the bearing bores 28 are cast integrally as part of the monolithic cylinder-crankcase 2. However, in alternative embodiments the bearing bores may be machined into the cylinder-crankcase.

Figure 3:
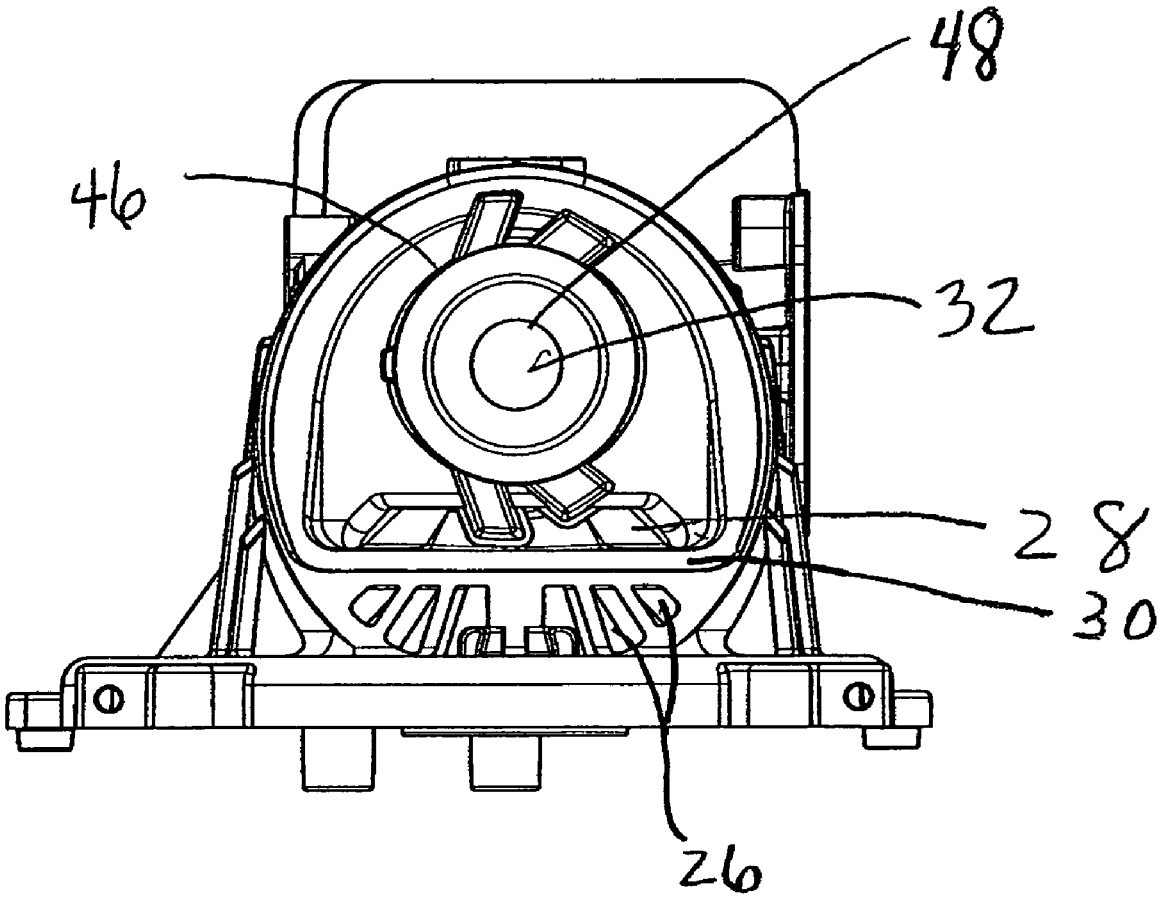
FIG. 3 is a bottom view of the cylinder-crankcase of FIG. 1 without additional engine components.

The crankcase includes a plurality of fingers 22 that surround the crank arm 12. Lower fingers 24 act as fins to facilitate the entry of cooling air into the cylinder block in order to cool the cylinder-crankcase 2. Referring to FIGS. 1 and 7, air preferably is drawn into the cylinder block via a reverse flow pattern, depicted by arrows 33. To cool the cylinder-crankcase, cooling air enters from the rear of the crankcase (i.e., the side opposite the side containing the crank arm 12) into holes 26 located between the lower fingers 24. Upon passing through the holes 26, the air passes into the crankcase and enters the cylinder block (FIGS. 2 and 3). The air exits via a plurality of fins 34 located on an exterior surface 36 of the cylinder block.

Figure 4:
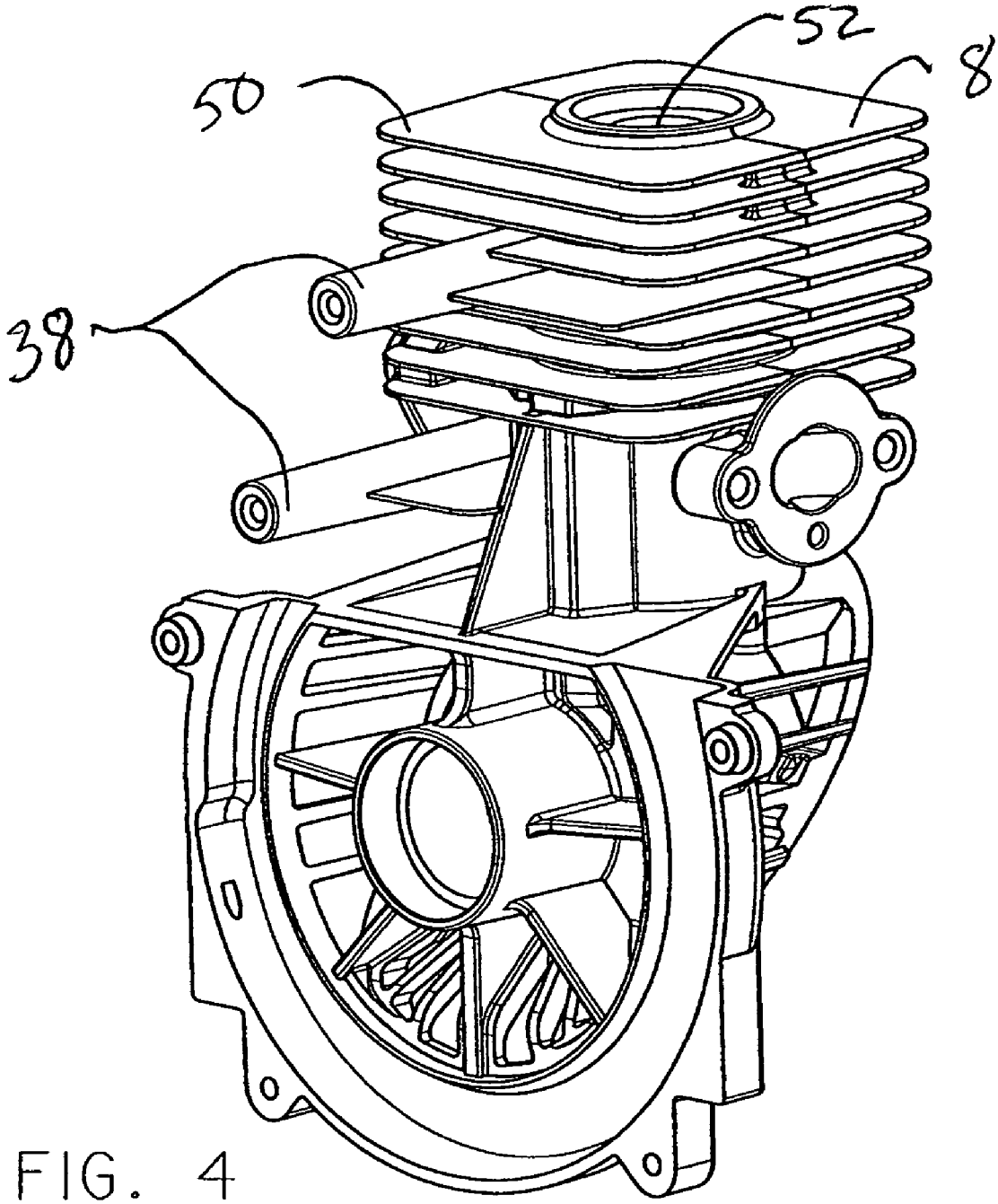
FIG. 4 is an alternate embodiment of a front perspective view of a cylinder-crankcase.
Figure 5:
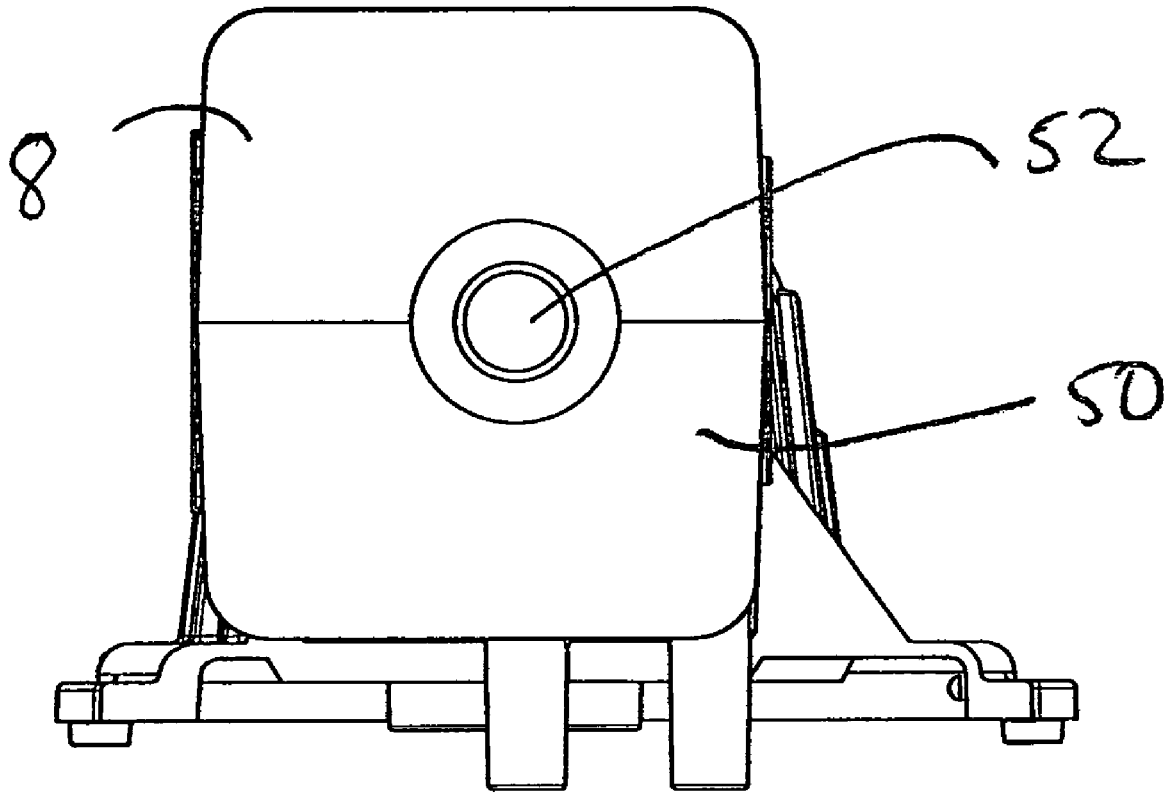
FIG. 5 is a top view of the cylinder-crankcase of FIG. 3.

The cylinder block 6 also includes several portions for the attachment of various engine components. For example, the cylinder block includes at least one boss 38 that receives a mounting screw in order to mount a spark plug initiator such as an ignition module. As shown in FIGS. 1 and 4, the boss 38 can have numerous configurations suitable for the mounting of the spark plug initiator.

The cylinder block 6 also includes an exhaust mounting 40 and a carburetor mounting 42 for the attachment of an exhaust and carburetor, respectively. Although the exhaust and carburetor mountings 40, 42 may be configured in a variety of ways with respect to each other (i.e., side by side, etc.), those skilled in the art will recognize that it is preferable to locate the exhaust and carburetor mountings 40, 42 on opposite sides of the cylinder block 6 so that the heat the carburetor may experience from the exhaust is reduced.

The cylinder block includes a chamber 32 for housing a reciprocating piston assembly that moves within the chamber and that is connected to the connecting rod 18 described above. As explained further below, the chamber also receives a gaseous mixture of fuel and air from the crankcase. A lower face 46 of the cylinder block includes an opening 48 that allows the piston assembly to be placed within the chamber 32. Referring to FIGS. 6 and 7, the cylinder block also includes a plurality of passages 30 that facilitates the passage of the gaseous mixture from the crankcase and into the chamber of the cylinder block. Preferably, the cylinder block will contain four ports. The passages 30 are cast integrally as part of the monolithic cylinder-crankcase 2.

The cylinder head 8 is located atop the cylinder block 6, and as explained above, is cast monolithically with the cylinder block 6 and crankcase 4. While the cylinder head 8 may have numerous configurations, in a preferred embodiment, the cylinder head 8 is comprised of at least one fin 50 similar to the plurality of fins 34 associated with the cylinder block 6. The fin 50 includes an opening 52 that opens into the chamber 32 of the cylinder block. The opening 52 is for the reception of a spark plug 54 that is threaded through the cylinder head 8 and partially into the chamber 32.

The operation of the engine is as follows: as the piston assembly moves upwardly within the chamber, a vacuum will be created that draws the gaseous mixture of fuel and air from the carburetor and into the crankcase. At the same time, during the upward stroke of the piston, any gaseous mixture already in the chamber will be compressed and ignited by the sparkplug, producing a high-pressure charge. This charge, in turn, will drive the piston in a downwardly direction, allowing any gases remaining in the chamber to be expelled through the exhaust, and allowing the gaseous mixture in the crankcase to enter into the chamber by passing through the passages. The upward and downward movement of the piston, in turn, will drive the connecting rod and crankshaft.

As explained above, the entire cylinder-crankcase (i.e., the crankcase, including the crank arm and cylinder bores, cylinder block and cylinder head) is cast as one monolithic piece. The present cylinder-crankcase therefore eliminates the need for additional fasteners and parts to assemble the cylinder-crankcase. This provides several benefits: 1) the parts forming the cylinder-crankcase do not need to be machined to "mate" or have aligning holes for fasteners 2) the weight of the cylinder-crankcase will be reduced due to the lack of fasteners; and 3) joint weakness and fracture, which is most likely to occur in areas where parts are fastened together, will be greatly reduced since the cylinder-crankcase is monolithic. Moreover, unlike prior-art cylinder crankcases, the present cylinder-crankcase can support bearings, via the integral bearing bores, without requiring additional, separate supporting components.

Similarly, the monolithic cylinder-crankcase also eliminates the need for gaskets and other seals that typically are required for cylinder-crankcases that are fastened together. This in turn, provides the advantage of further reducing the weight of the cylinder-crankcase and eliminating failures often associated with seals such as deterioration and leakage, which can lead to the loss of compression.

Advantageously, the cylinder-crankcase also may be made through other processes and still retain the benefits enumerated above. The cylinder-crankcase may be formed through injection molding. A metal cylinder sleeve, made of a material such as cast-iron, may then be inserted into the cylinder block via the opening 48 in the cylinder block. Not only are the above benefits still realized, but the addition of the sleeve will reduce noise generated by the engine. In alternate embodiments, the cylinder-crankcase may be molded over the sleeve when the cylinder-crankcase is being formed.

It is therefore intended that the foregoing detailed description be regarded as illustrative rather than limiting, and that it be understood that it is the following claims, including all equivalents, that are intended to define the spirit and scope of this invention. For example, although the cylinder-crankcase 2 has been described in conjunction for use with a two-stroke cylinder engine, those skilled in the art will appreciate that the monolithic cylinder-crankcase may be used in conjunction with a four-stroke cylinder engine.

What is claimed is:

1. A cylinder-crankcase, comprising:

a cylinder block having a cylinder head for receiving a spark plug;

a crankcase connected with the cylinder block; and a crank arm for supporting a crankshaft connected with the crankcase;

wherein the cylinder block cylinder head, crankcase and crank arm are a single, monolithic piece;

wherein the cylinder block further comprises:

a chamber for the combustion of a gaseous mixture;

at least one passage that, at selected times, provides fluid communication between the crankcase and the chamber, and wherein the at least one passage is part of the monolithic cylinder-crankcase.

2. The cylinder-crankcase of claim 1, wherein the at least one passage comprises four passages.

3. The cylinder-crankcase of claim 1, wherein the cylinder head comprises at least one fin contiguous with the plurality of fins of the cylinder block.

4. The cylinder-crankcase of claim 1, further comprising:

a metal cylinder sleeve located within the cylinder block;

wherein the cylinder block, cylinder head, crankcase and crank arm are molded over the cylinder sleeve.

5. The cylinder-crankcase of claim 1, wherein the crankcase further comprises a plurality of fingers surrounding the crank arm, the fingers facilitating the passage of cooling air into the cylinder block.

6. The cylinder-crankcase of claim 5, wherein at least two of the plurality of fingers are located on a lower portion of the crankcase, and wherein the crankcase further comprises a hole located between the at least two of the plurality of fingers, the holes allowing the cooling air to pass between the fingers.

7. The cylinder-crankcase of claim 5, wherein the passage of cooling air into the cylinder block further comprises a reverse flow pattern.

8. The cylinder-crankcase of claim 1, wherein the cylinder block includes at least one boss for mounting an ignition module.

9. The cylinder-crankcase of claim 1, wherein the crank arm is configured to support a crankshaft having one counterweight and a connecting rod attachment point.

10. A cylinder-crankcase including a cylinder block having a cylinder head for receiving a spark plug and a crankcase having a crank arm for supporting a crankshaft of an engine, the cylinder block further comprising a chamber for combustion of a gaseous mixture, and at least one passage providing fluid communication between the chamber and the crankcase, wherein the improvement comprises:

casting the cylinder block, cylinder head, and crankcase, including the chamber and at least one passage, as a single monolithic piece.

11. The cylinder-crankcase of claim 10, wherein the cylinder block, cylinder head, and crankcase are formed of stainless steel.

12. The cylinder-crankcase of claim 10, wherein the cylinder block, cylinder head, and crankcase are formed of aluminum.

13. The cylinder-crankcase of claim 10, wherein the cylinder block includes a spark plug initiator.

14. The cylinder-crankcase of claim 10, wherein the chamber in the cylinder block further comprises a housing a piston assembly.

15. The cylinder-crankcase of claim 10, wherein the crankcase further comprises a plurality of fingers surrounding the crank arm, the fingers facilitating the passage of cooling air into the cylinder block.

16. The cylinder-crankcase of claim 15, wherein at least two of the plurality of fingers are located in a lower portion of the crankcase, and wherein the crankcase further comprises a hole located between the at least two of the plurality of fingers, the holes allowing the cooling air to pass between the fingers.

17. The cylinder-crankcase of claim 16, wherein the passage of cooling air into the cylinder block further comprises a reverse flow pattern.

18. The cylinder-crankcase of claim 10, wherein the at least one passage further comprises four passages, each of the passages having a plurality of ports, at least one of the ports opening to the crankcase and at least another of the ports opening to the chamber thereby providing for fluid communication of a gaseous mixture from the crankcase and into the chamber.

19. The cylinder-crankcase of claim 10, wherein the cylinder block, cylinder head, and crankcase are formed of cast iron.

20. A method for forming a cylinder-crankcase, wherein the method comprises forming a cylinder block, cylinder head, crankcase, and crank arm, including a chamber in the cylinder block and a passage for providing fluid communication between the crankcase and the chamber, as a single, monolithic piece so that the cylinder-crankcase is formed without any fasteners and gaskets for assembling and sealing the cylinder-crankcase.

21. The method of claim 20, wherein the cylinder block, cylinder head, crankcase, and crank arm are die-casted.

22. The method of claim 21, further comprising die-casting the crank arm with at least two bearing bores therein.

23. The method of claim 20, wherein the cylinder block, cylinder head, crankcase, and crank arm are injection molded.

24. The method of claim 23, further comprising molding the cylinder block, cylinder head, crankcase, and crank arm over a metal sleeve, wherein the sleeve is located within the cylinder block.

25. The method of claim 23, further comprising inserting a metal sleeve within the cylinder block.

26. The method of claim 23, further comprising injection-molding the crank arm with at least two bearing bores therein.

27. The method of claim 20, further comprising forming a plurality of fingers as part of the single, monolithic piece, the plurality of fingers surrounding the crank arm.

28. The method of claim 20, further comprising forming a plurality of passages as part of the single, monolithic piece, the plurality of passages located within the cylinder block.

* * * * *